US006386747B1

(12) United States Patent
Liao et al.

(10) Patent No.: US 6,386,747 B1
(45) Date of Patent: May 14, 2002

(54) APPARATUS FOR MIXING CEMENT

(76) Inventors: Shu-Hung Liao; Shu Yuan Liao; Chu-San Nieh, all of PO Box 82-144, Taipei (TW)

( * ) Notice: Subject to any disclaimer, the term of this patent is extended or adjusted under 35 U.S.C. 154(b) by 0 days.

(21) Appl. No.: 09/484,596

(22) Filed: Jan. 18, 2000

(51) Int. Cl.[7] ..... B28C 5/16
(52) U.S. Cl. ..... 366/46; 366/65
(58) Field of Search ..... 366/62, 64–67, 366/97–98, 192–193, 242, 244–251, 261, 314, 45–48; 403/345, 348, 355, 356, 359.6, 360, 375; 464/137, 157, 149; 108/25, 110, 147.13, 150; 280/79.2, 79.5, 47.34, 47.35

(56) References Cited

U.S. PATENT DOCUMENTS 4,134,686 A * 1/1979 Hauser et al. ..... 366/47
4,191,478 A * 3/1980 Zupancic et al.
4,521,116 A * 6/1985 Adsit
4,802,783 A * 2/1989 Erikson
5,137,366 A * 8/1992 Hill et al. ..... 366/47
5,419,633 A * 5/1995 Lorenzetti et al.
5,730,657 A * 3/1998 Olgren

* cited by examiner

*Primary Examiner*—Charles E. Cooley
(74) *Attorney, Agent, or Firm*—A & J

(57) ABSTRACT

An improved structure of a cement mixing apparatus comprising a base frame, two supporting frames, a panel, a mixing cylinder and a transmission mechanism, characterized in that the base seat has a substantial square shaped structure having a plurality of mounting holes for screws; the supporting frame is a H-shaped structure with a plurality of mounting holes for screws to mount a reinforcing plate at the top end of the supporting frame to the base frame, the two supporting frames are mounted together with the reinforcing plate as a unit such that the base flames and two supporting frames are formed into a framework structure.

1 Claim, 20 Drawing Sheets

APPARATUS FOR MIXING CEMENT

BACKGROUND OF THE INVENTION a) Technical Field of the Invention

The present invention relates to an apparatus for mixing cement, and in particular, to a cement mixing device which can be easily operated in the mixing process, or easily assembled for mixing process.

b) Description of the Prior Art

Conventional cement mixing apparatus is shown in FIGS. 1, 2 and 3. The mixing apparatus has a mixing cylinder 92 mounted with a power mechanism 93. Via a transmission shaft 94, power is transmitted to the mixing arm 80 of the apparatus such that the mixing cylinder 92 proceeds to mix cement, sand and water. Referning to FIGS. 1 to 4, the bottom portion of the mixing apparatus is a frame 91 with four mounting bolts 911 at the four comers thereof. The interior of the Same 91 can accommodate the transmission mechanism 93, which is mounted at a panel 912 on the frame 91. The center of the panel 912 is provided with a through hole 913 for the extension of the mounting portion 931 of the transmission mechanism 93. The bottom portion of the mixing cylinder 92 is provided with a circular hole 921 for the extension of a mounting portion 941 of the ts sion shaft 94. The mounting portion 941 can engage with the mounting portion 931 of the transmission mechanism 93. The bottom end of the mixing cylinder 92 has an arch-shaped slot 923 and a straight slot 922 which can be mounted with the mounting bolt 911. The mounting bolt 911 can be secured using screws, and the mixing cylinder 92 can be fitted to the frame 91. By removing the screws, the mixing cylinder 92 can rotate 90 degrees facilitating moving the mixing device into a house through a narrow door.

As shown in FIG. 5, the interior of the mixing cylinder 92 is provided with a cylinder tube 95 having mounted with bearings enclosing the transmission shaft 94. The transmission shaft can be rotated within the cylinder tube 95. The mixing cylinder 92 drives the cylinder tube 95 to rotate 90 degrees. One end of the transmission shaft 94 is connected to the mixing arm 80, and the other end is connected to the transmission mechanism 93. Power is transmitted from the transmission mechanism 93 to the mixing arm 80.

Referring to FIG. 6, an outlet 924 is provided at the bottom of the mixing cylinder 92 and after the cement is mixed, it is poured out through the outlet 924. There are drawbacks found in the conventional cement mixing device 1) The height of the mixing cylinder is higher than the height of the cart to allow pouring out of the mixed cement. Therefore, it is laborious to place the mixing materials prior to mixing.
2) The material for the mixing cylinder is thick and heavy. Therefore, the cost of making the same is high.
3) The mounting of the cylinder tube with the mixing cylinder is complicated.
4) The mixing cylinders can not be stacked together. Therefore, it is not convenient in transporting from the manufacturer to work site.
5) The alignment of the center of the transmission shaft and the transmission mechanism is difficult to achieve.
6) The storage of the entire structure of the cement mixing apparatus is difficult.
7) There are too many parts making up the apparatus. Therefore, the cost of manufacturing is expensive.

SUMMARY OF THE INVENTION

Accordingly, it is an object of the present invention, is to provide an improved structure of a cement mixing apparatus comprising a base frame, two supporting frame, a panel, a mixing cylinder and a transmission mechanism, characterized in that the base seat has a substantial square shaped structure having a plurality of mounting holes for screws; the supporting frame is H-shaped structure with a plurality of mounting holes for screws to mount a reinforcing plate at the top end of the supporting frame to the base frame, and the two supporting frames are mounted together with the reinforcing plate as a unit such that the base frame and two supporting frame are formed into a framework structure.

DETAILED DESCRIPTION OF THE PRESENT INVENTION

Figure 1:
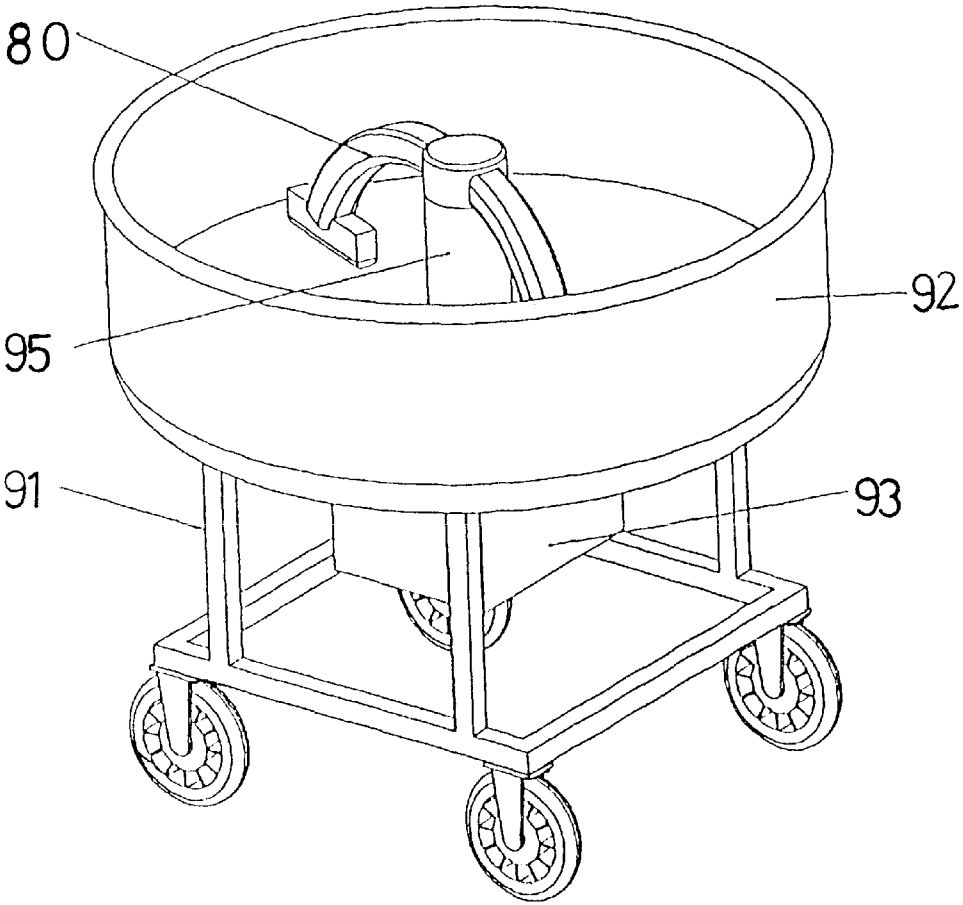
PRIOR ART FIG. 1
FIG. 1 is a perspective view of a conventional cement mixing apparatus.
Figure 2:
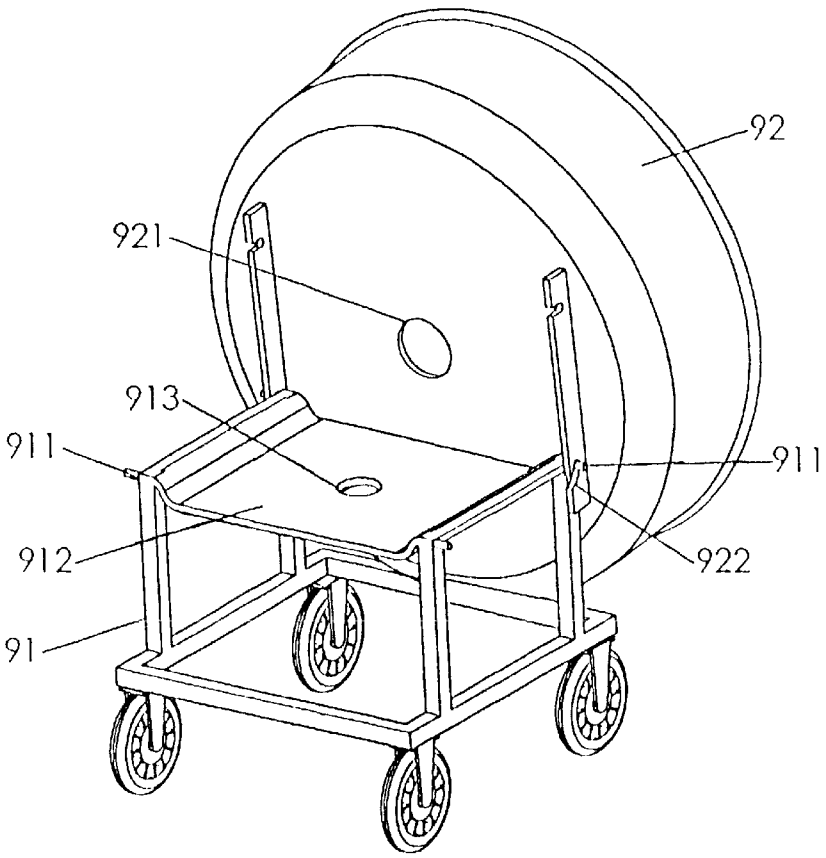
PRIOR ART FIG. 2
FIG. 2 is a perspective view of a conventional cement mixing apparatus after it rotated.
Figure 3:
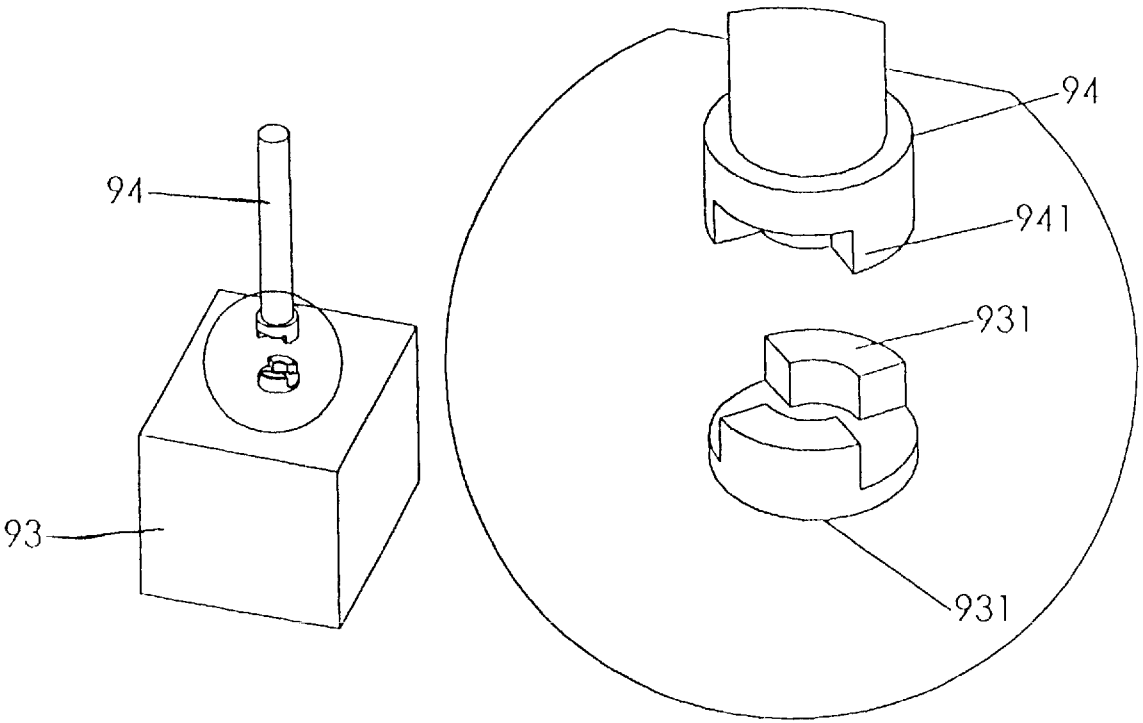
PRIOR ART FIG. 3
FIG. 3 is a schematic view showing conventional transmission mechanism and the transmission shaft.
Figure 4:
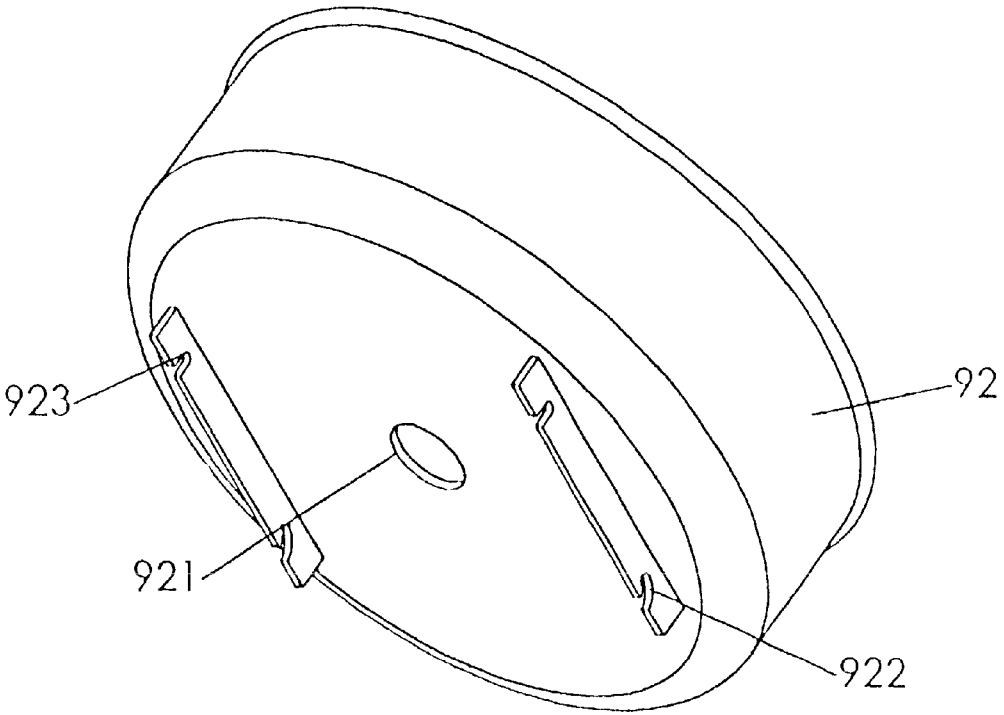
PRIOR ART FIG. 4
FIG. 4 is a perspective view of a conventional mixing cylinder.
Figure 5:
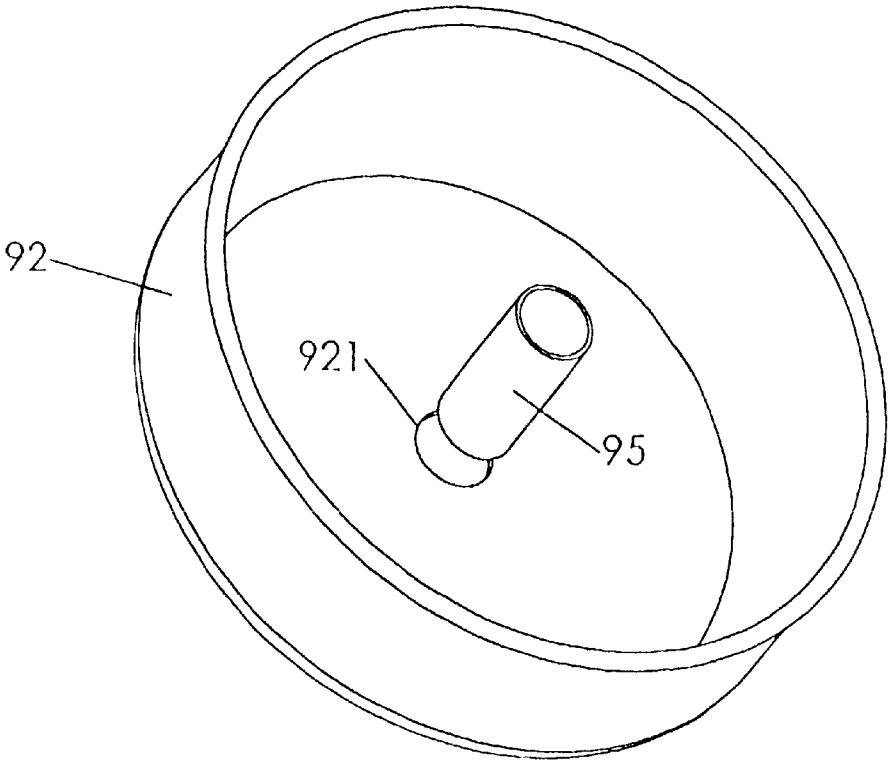
PRIOR ART FIG. 5
FIG. 5 is a schematic view showing the combination of a mixing cylinder and the cylinder center.
Figure 6:
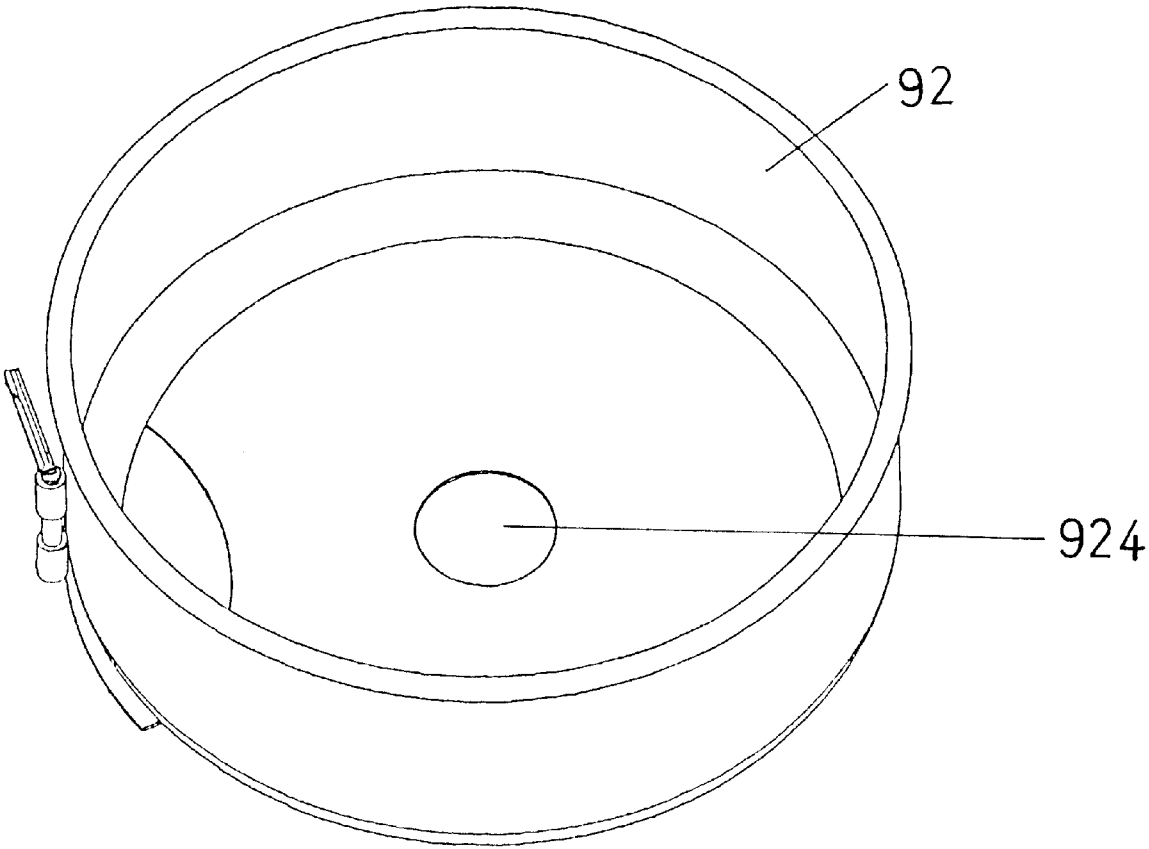
PRIOR ART FIG. 6
FIG. 6 is a schematic view showing the combination of the outlet and outlet baffle plate.

The present apparatus for mixing cement comprises a base frame 20, two supporting frames 10, a panel 30, a mixing cylinder 40, and a transmission mechanism 60.

Figure 7:
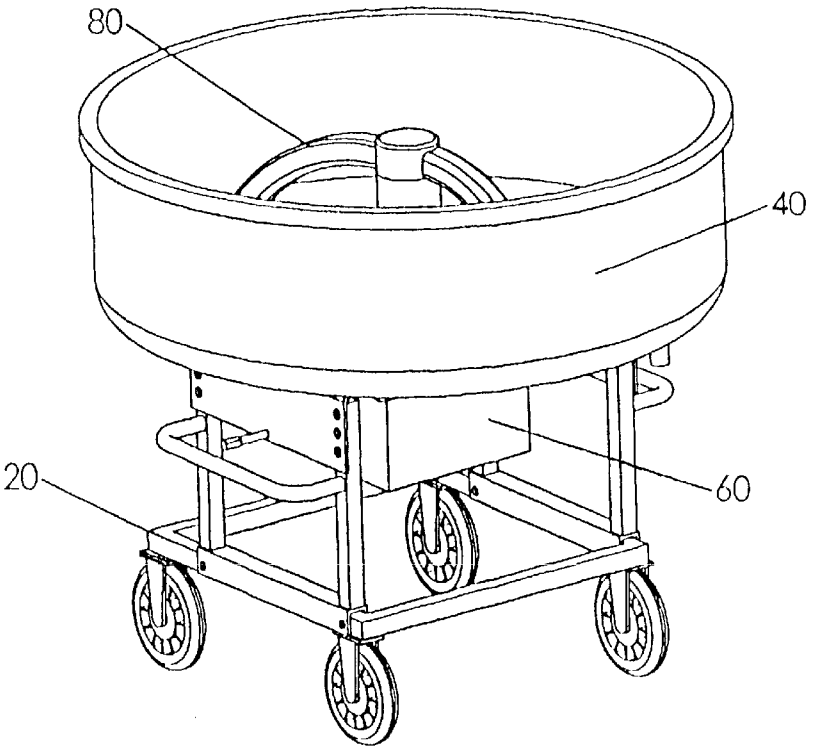
FIG. 7 is a perspective view of the cement mixing apparatus of the present invention.
Figure 8:
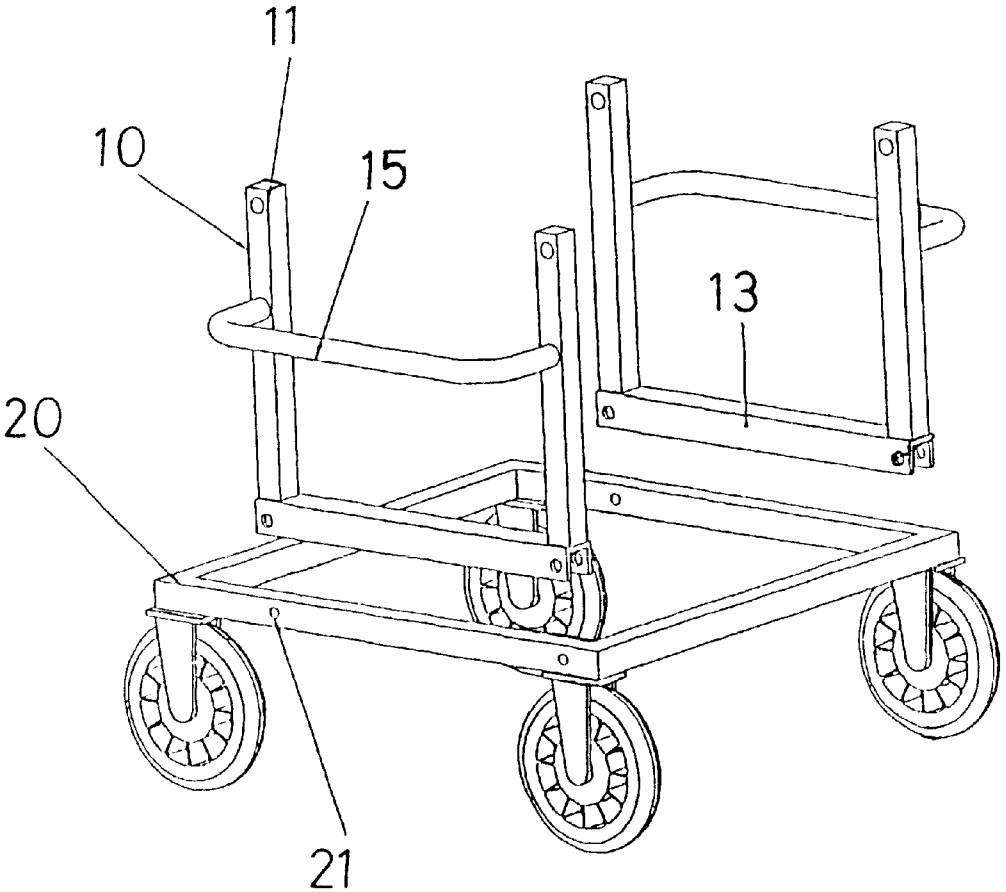
FIG. 8 is a perspective view of the bottom frame and the supporting frame in accordance with the present invention.
Figure 9:
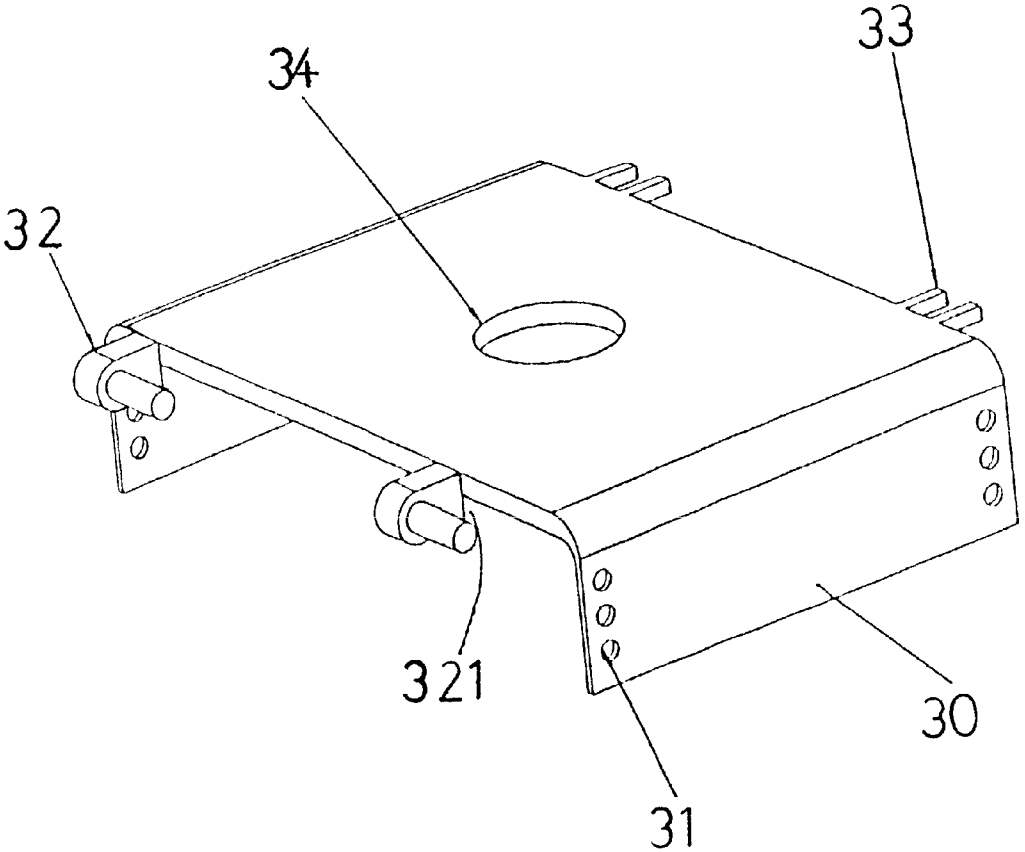
FIG. 9 is a perspective view of the panel of the cement mixing apparatus in accordance with the present invention.

Referning to FIGS. 7 and 8, the base frame 20 is substantially a square shape structure mounted with a plurality of wheels. A plurality of mounting holes 21 are provided on the frame 20 for the mounting with screws. The two supporting frames 10 are each H-shaped frame body having a plurality of mounting holes 11 to secure with a reinforcing plate 13 and a handle 15. The two supporting frames 10 and the reinforcing plate 13 are combined to form as a unit The fame is shown in FIG. 8.

Referring to FIGS. 9, 10, 11 and 12, a transmission mechanism 60 is mounted onto the panel 30 and includes a motor and a speed reducing member. The panel 30 is an arc-shaped structure, and the center thereof is a through hole 34 such that a mounting section 601 of the transmission mechanism 60 can be protruded out. A plurality of mounting holes 31 are provided on the two sides of the panel 30 and are mounted with a plurality of screws onto the supporting frame 10. Thus, the transmission mechanism 60 and the panel 30 are supported by the two supporting frames 10 and the base frame 20. Besides, one side of the panel 20 is provided with two mounting slots 33 corresponding to two blocks 32. An insertion space is formed between the block 32 and the panel 30. The bottom end of the mixing cylinder 40 is provided with a circular hole 403 to allow the transmission shaft 61 to extend outward. Two movable bolts 401 and two fasteners 402 are provided to the bottom end. The fastener 402 can hook onto the blocks 32 and the moving bolt 401 can engage with the mounting slot 33 of the panel 30. By using screws, the mixing cylinder 40 is fitted to the panel 30. When the screws are removed from the moving bolt 401, the moving bolt 401 can withdraw from the mounting slot 33. By rotating the mixing cylinder 40, the fastener 402 can rotate 90 degrees with reference to the block 32 of the panel 30.

Figure 12:
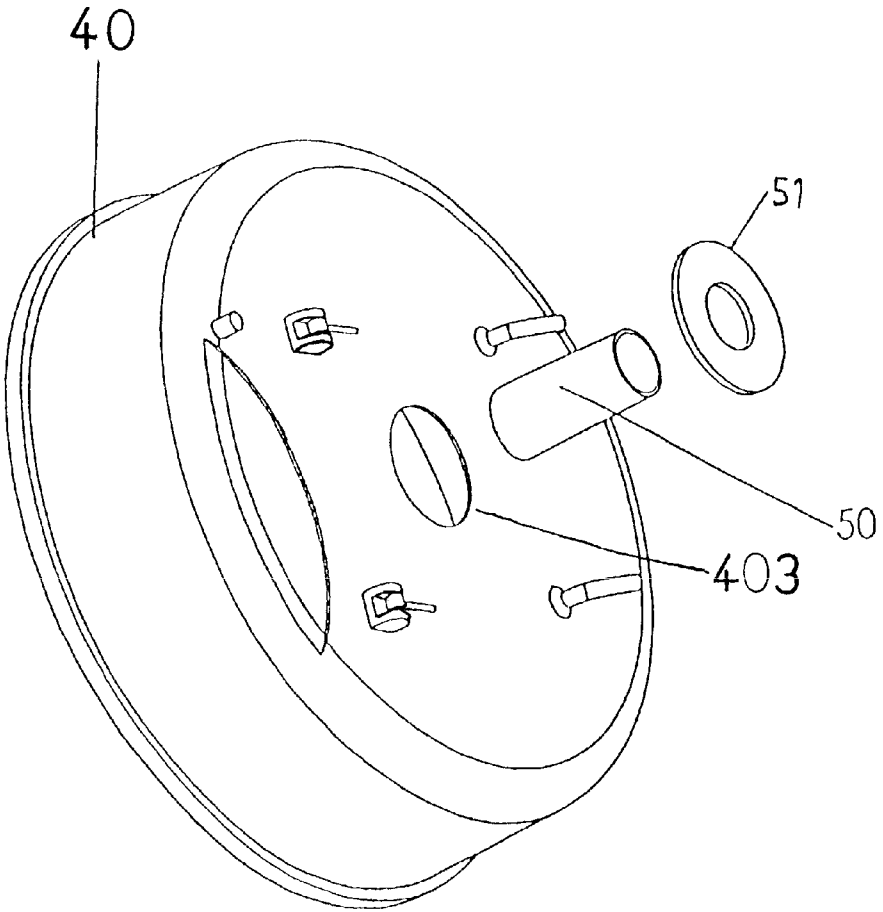
FIG. 12 is a schematic view of the combination of the mixing cylinder and the cylinder center in accordance with the present invention.
Figure 13:
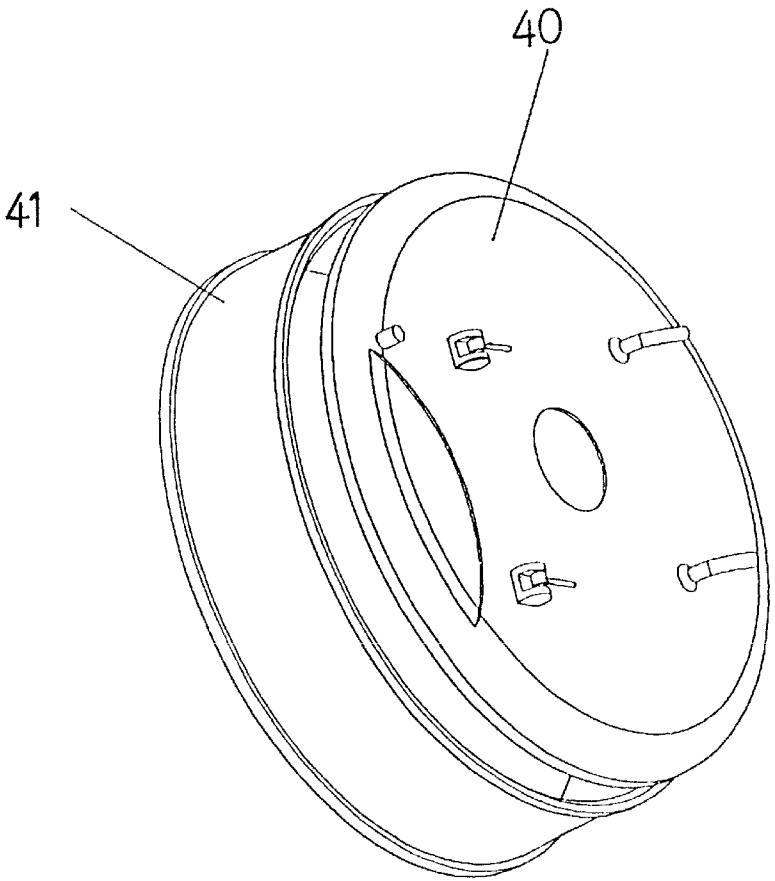
FIG. 13 is a perspective view of another preferred embodiment of the mixing cylinder in accordance with the present invention.
Figure 14A:
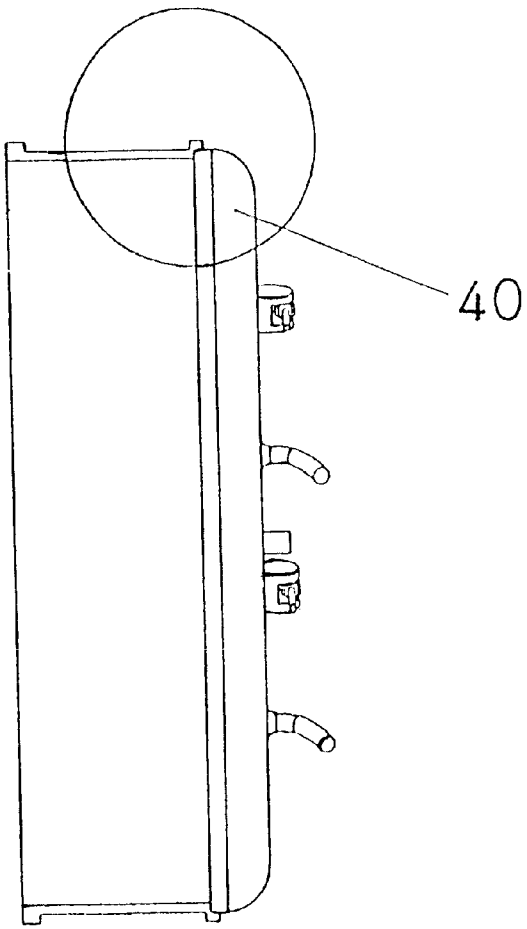
FIG. 14A is a sectional view of another preferred embodiment of the mixing cylinder in accordance with the present invention.
Figure 14B:
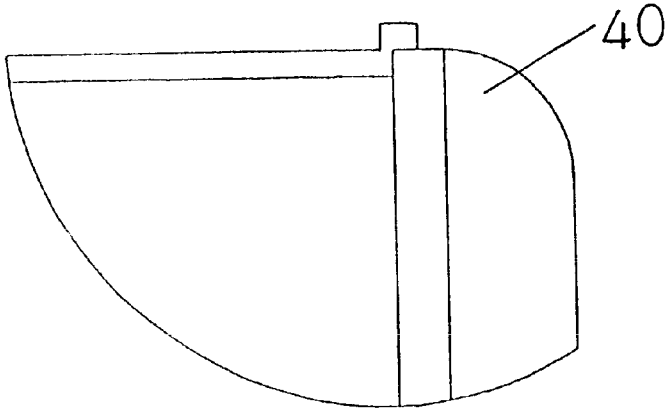
FIG. 14B is an enlarged view of a portion of FIG. 14A.

Referring to FIG. 12, the center of the mixing cylinder 40 is provided with a circular through hole 403. The top portion of the hole 403 is provided with abase disc 51 and a tube 50 is connected to the base disc 51. Then the entire structure is welded together with the mixing cylinder 40.

Figure 10:
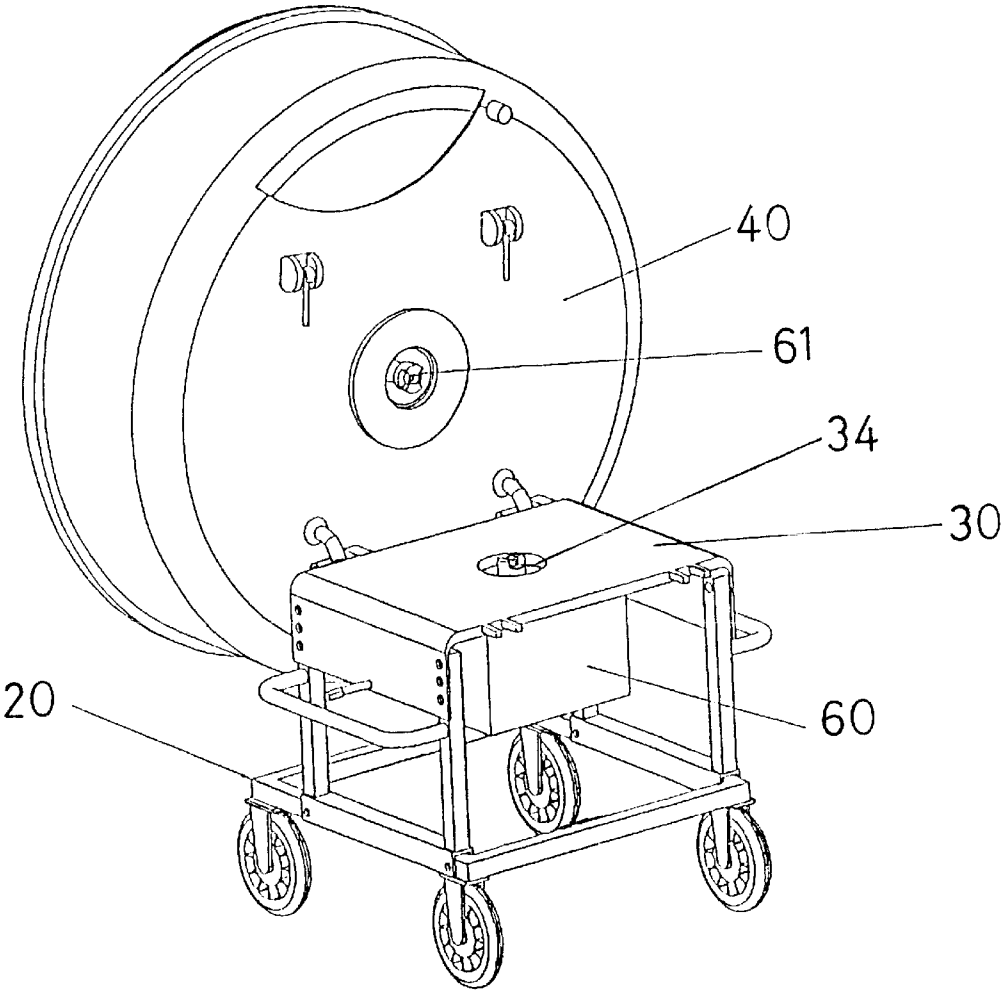
FIG. 10 is a perspective view of the cement mixing apparatus after it rotated in accordance with the present invention.
Figure 11:
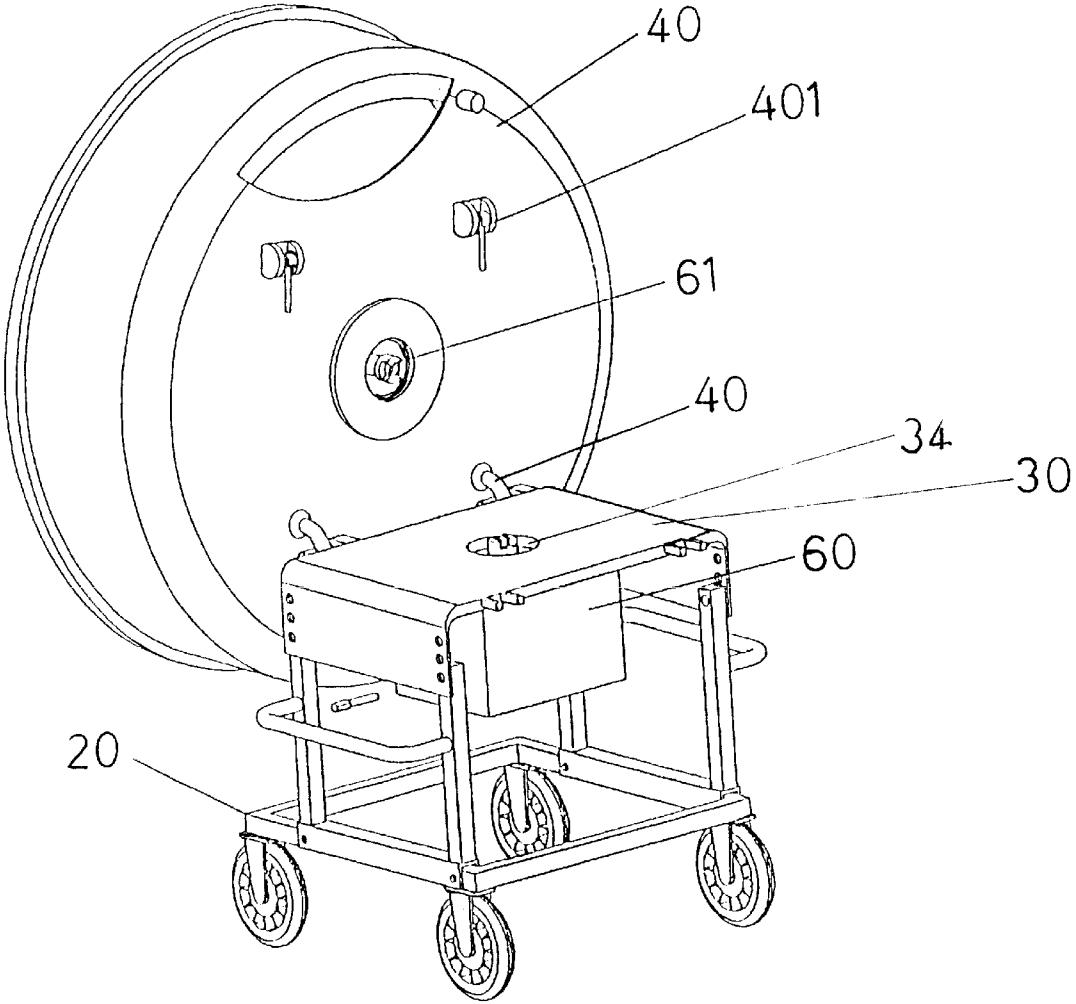
FIG. 11 is a perspective view of the cement mixing apparatus after its height is elevated in accordance with the present invention.

In combination, the bottom frame 20 and the supporting frame 10 and the reinforcing plate 13 are combined together by screws. The transmission mechanism 60 is combined with the panel 30 and can be placed within the space formed by the fame 10. The mounting holes 11 of the supporting frame 10 are combined with the mounting holes 31 of the panel 30 at the top thereof by screws. As shown in FIG. 10, the height of the panel 30 is at the lowest.

The mixing cylinder 40 is located at the panel 30, i.e., the mixing cylinder 40 is at the lowest. The transmission mechanism 60 and the transmission shaft 61 pass through the through hole 403 of the mixing cylinder 40. Thus, the structure of the cement mixing is obtained.

Figure 20:
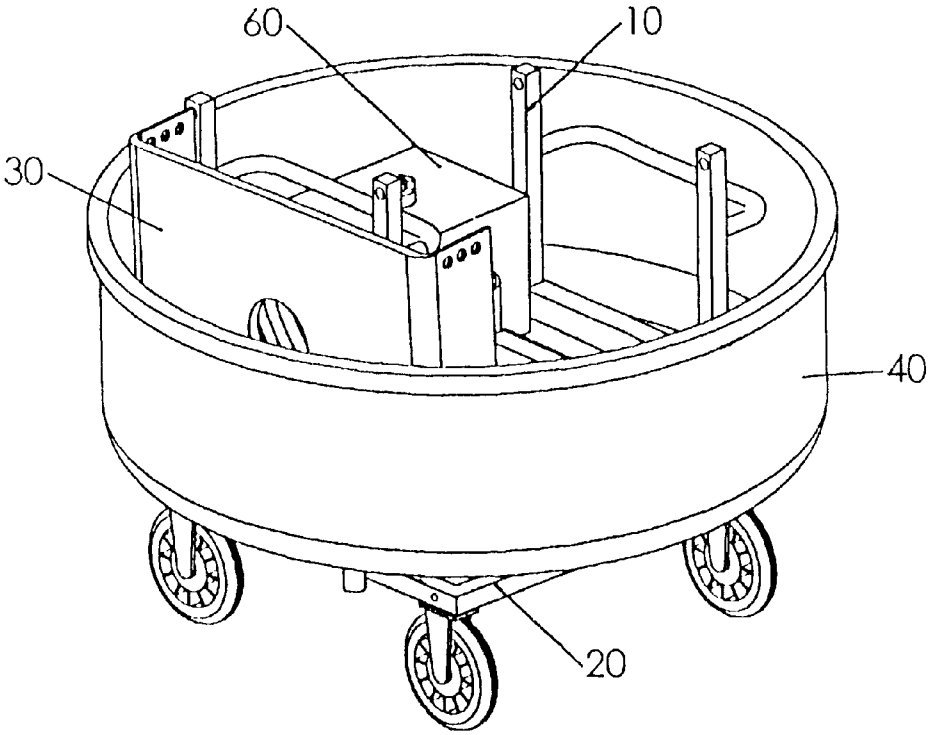
FIG. 20 is a perspective view showing the cement mixing apparatus for storage.

In accordance with the present invention, and as shown in FIGS. 11, 12, 13, 14A and 14B, when the mounting hole 11 of the supporting frame 10 and the mounting hole 31 at the bottom end of the panel 30 are combined with screws, the height of the panel 30 is the highest. If maintenance or servicing is required, the screws are removed and the bottom fame 20, the supporting frame 10, the transmission mechanism 60, the panel 30 and the mixing cylinder 40 are individually removed. All these parts can be placed within the interior of the mixing cylinder 40 for easy transportation and storage, which is shown in FIG. 20.

Figure 15B:
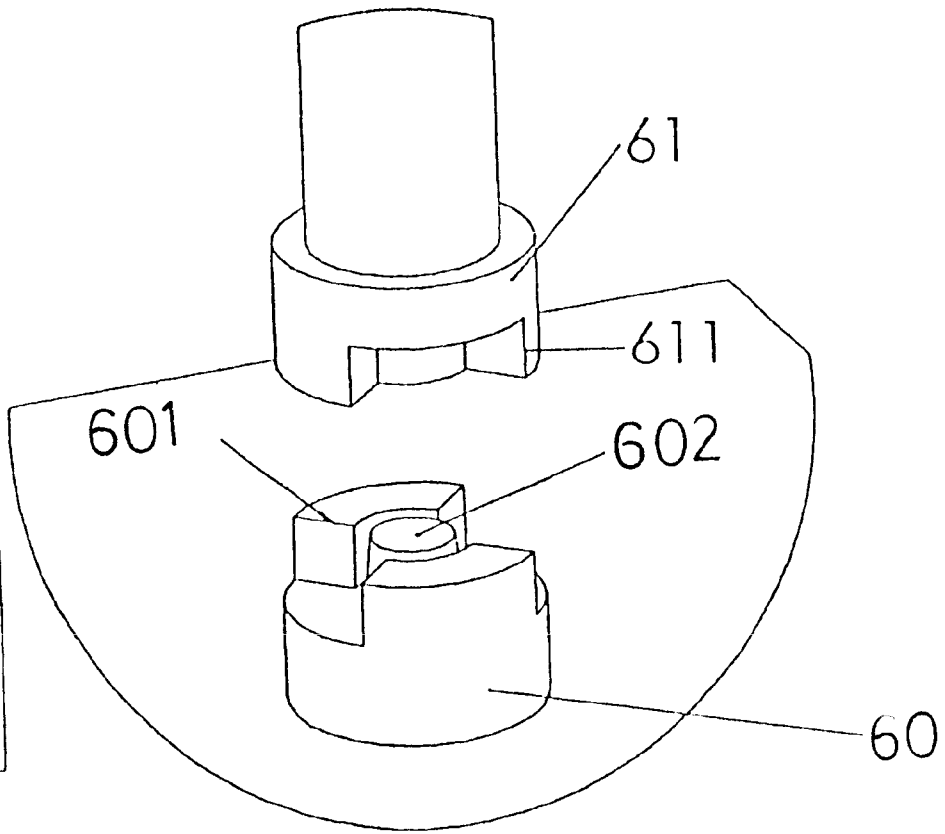
FIG. 15B is an enlarged view of a portion of FIG. 15A.
Figure 15A:
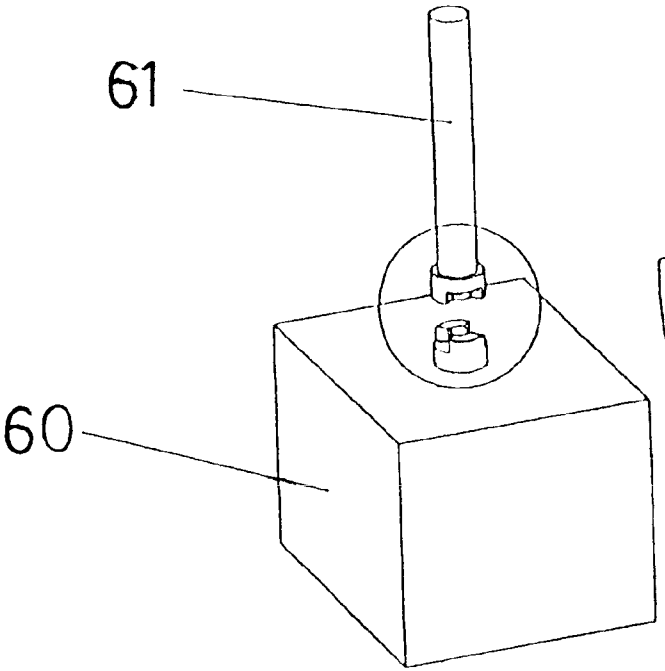
FIG. 15A is a schematic view of the combination of the admission mechanism and the transmission shaft in accordance with the present invention.

Referring to FIGS. 15A and 15B, there is shown another preferred embodiment in accordance with the present invention. Mounting portions 601, 611 are provided respectively at the transmission mechanism 60 and the transmission shaft 61. The center of the mounting portion 601 is provided with a protruded tube 602 having a conic shape or an inverted corner facilitating mounting with the mounting portion 611 of the transmission shaft 61.

Figure 16:
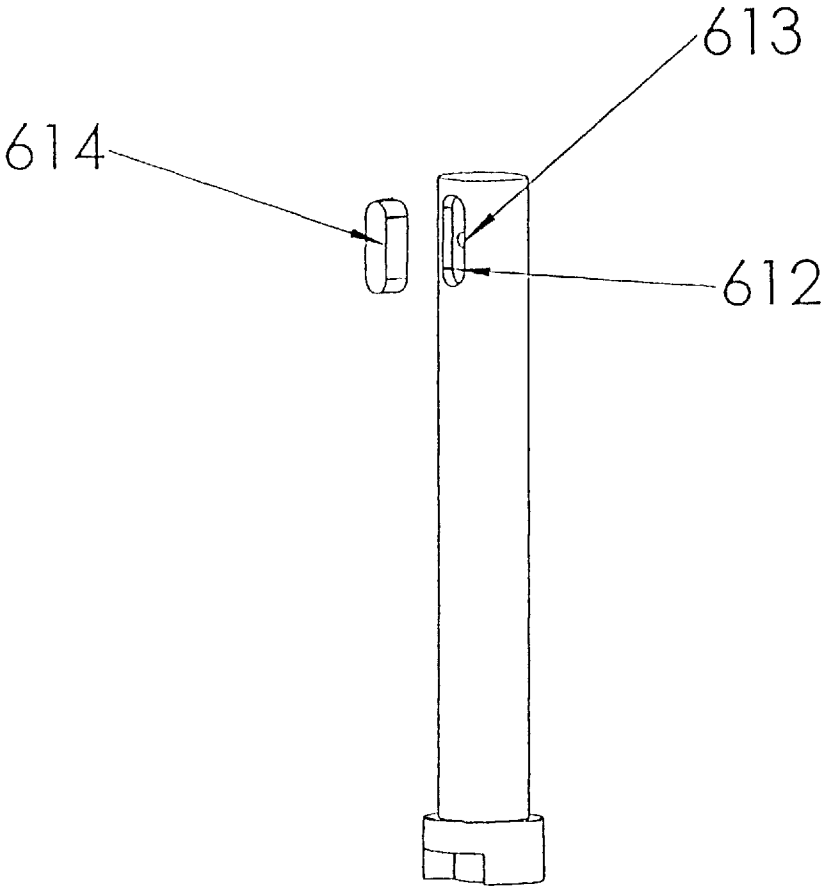
FIG. 16 is a schematic view showing the combination of the transmission shaft and the peg in accordance with the present invention.
Figure 17:
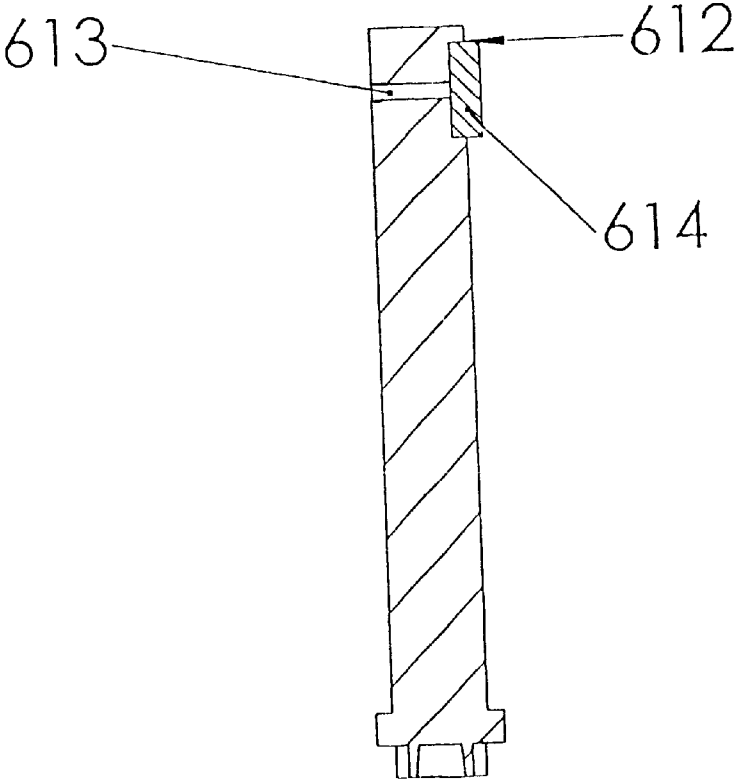
FIG. 17 is a sectional view showing the combination of the transmission shaft and the peg in accordance with the present invention.

Referning to FIGS. 16 and 17, the transmission shaft 61 and the mixing arm 80 are mounted together with a peg 614. The peg 614 is first mounted at the mounting slot 612 of the transmission shaft 61. During mixing, the transmission shaft 61 employs the peg 614 to rotate the mixing arm 80. Thus, the peg 614 may be broken easily. In accordance with the present invention, a through hole 613 is provided to the mounting slot 612 of the mission shaft 61 such that if the peg 614 is broken, a thin rod is used to push out the broken peg 614 through the through hole 613.

Figure 18:
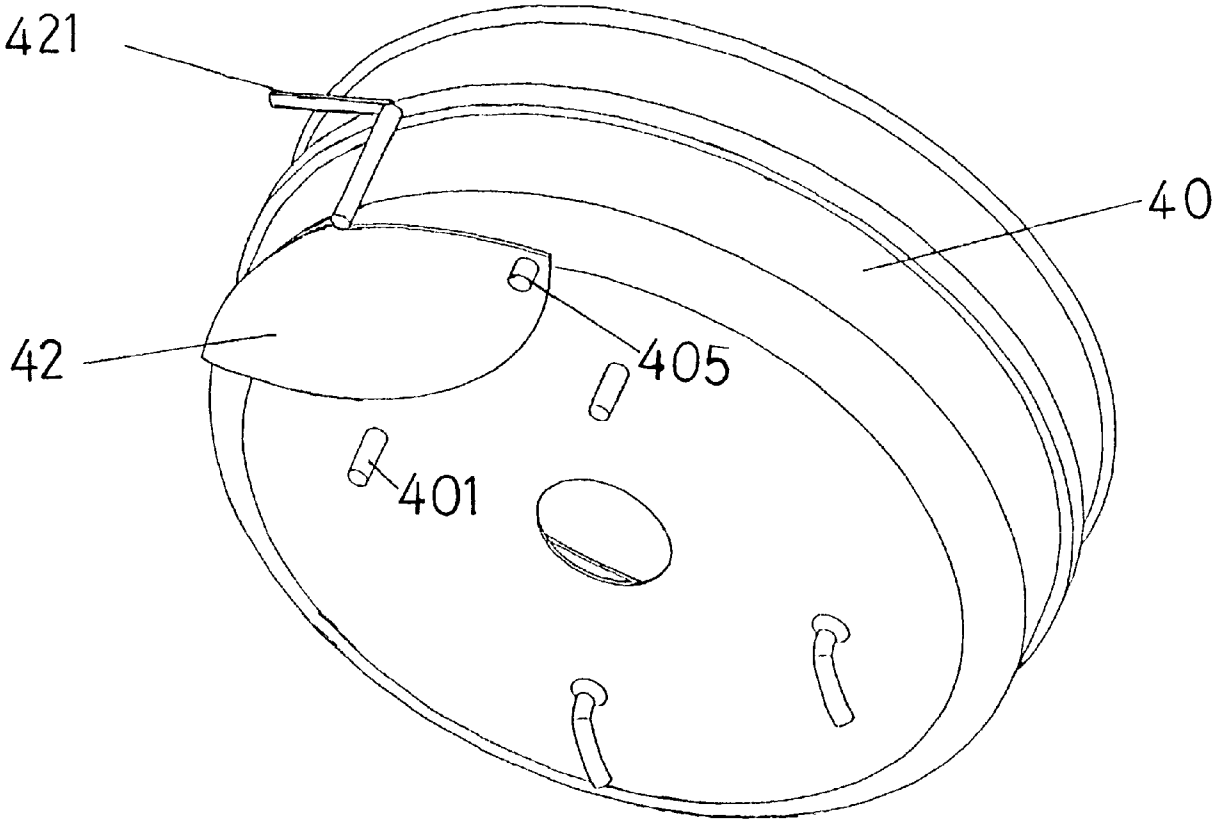
FIG. 18 is a perspective view showing the combination of the outlet of the mixing cylinder and the outlet baffle plate in accordance with the present invention.
Figure 19:
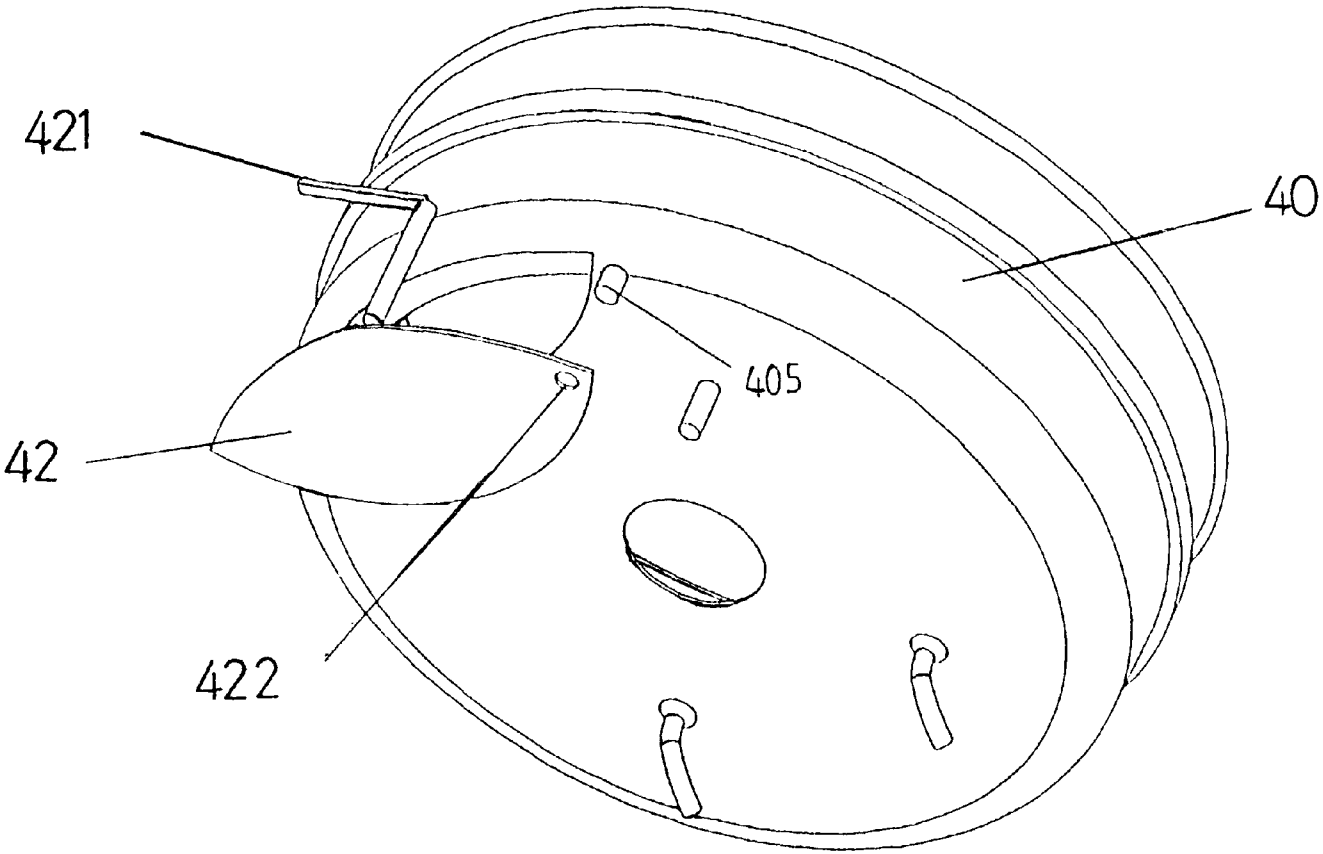
FIG. 19 is a perspective exploded view of the outlet and the outlet baffle plate in accordance with the present invention.

As shown in FIGS. 18 and 19, the cylinder base of the mixing cylinder 40 is provided with a bolt 405. The outlet baffle plate 42 is provided with a mounting hole 422 so that the baffle plate 42 can be mounted to the bolt 405 of the mixing cylinder 40. The bolt 405 is then fastened by screws, i.e., the outlet handle 421 of the baffle plate 42 can be rotated. The baffle plate 42 employs the bolt 405 of the mixing cylinder as the rotation center so as to open or to close the outlet 404 of the mixing cylinder 400.

While the invention has been described with respect to a preferred embodiment, it will be clear to those skilled in the art that modifications and improvements may be made to the invention without departing from the spirit and scope of the invention. Therefore, the invention is not to be limited by the specific illustrative embodiment, but only by the scope of the appended claims.

What is claimed is:

1. A cement mixing apparatus comprising a base frame, two supporting frames, each said supporting frame having a top and a bottom portion, a panel adjustably mounted to the top portions of said supporting frames, said panel having a plurality of mounting holes such that the height of the panel on the supporting frames can be adjusted, a mixing cylinder tiltably coupled to the panel, and a transmission mechanism with a transmission shaft attached to the panel, wherein the base frame is substantially square-shaped and has a plurality of mounting holes, each said supporting frame being H-shaped and having reinforcing plates at the bottom portion thereof, the reinforcing plates having mounting holes which correspond to the mounting holes of said base frame and which receive fasteners to removably attach the supporting frames to the base frame, said panel being arch-shaped and having an opening therein for the transmission shaft, said transmission shaft being removably coupled to an agitator arm in the mixing cylinder for mixing the cement.

* * * * *